US011493212B1

(12) United States Patent
Harper

(10) Patent No.: US 11,493,212 B1
(45) Date of Patent: Nov. 8, 2022

(54) AIR FILTRATION AND COOLING SYSTEM

(71) Applicant: Clark N. Harper, St. George, UT (US)

(72) Inventor: Clark N. Harper, St. George, UT (US)

( * ) Notice: Subject to any disclaimer, the term of this patent is extended or adjusted under 35 U.S.C. 154(b) by 232 days.

(21) Appl. No.: 15/936,817

(22) Filed: Mar. 27, 2018

(51) Int. Cl.

| | |
|---|---|
| ***F24F 3/16*** | (2021.01) |
| ***F24F 1/022*** | (2019.01) |
| ***F25B 49/02*** | (2006.01) |
| ***F24F 8/10*** | (2021.01) |

(52) U.S. Cl.
CPC ..... *F24F 1/022* (2013.01); *F24F 8/10* (2021.01); *F25B 49/022* (2013.01)

(58) Field of Classification Search
CPC .... B01D 46/44; B01D 46/10; B01D 2273/30; B01D 2279/40; B01D 46/008; B01D 46/54; B01D 53/0446; F24F 3/16; F24F 5/0035; B60H 3/0608; A61L 2209/16; F25B 2339/041
See application file for complete search history.

(56) References Cited

U.S. PATENT DOCUMENTS 2,068,478 A * 1/1937 Bergdoll ..... F25B 39/04 62/305
2,655,795 A * 10/1953 Dyer ..... F25B 39/04 62/305
4,204,409 A * 5/1980 Satama ..... F24F 5/001 62/271
4,939,907 A * 7/1990 Taylor ..... F24F 5/0035 62/305
5,509,853 A 4/1996 Wells
5,676,913 A * 10/1997 Cirillo ..... B01D 53/75 423/247
5,788,930 A 8/1998 McMurray
5,810,896 A * 9/1998 Clemens ..... B60H 1/00028 55/482
D416,320 S 11/1999 Prosper
6,090,188 A * 7/2000 Yang ..... B01D 53/0446 55/385.2
6,569,393 B1 5/2003 Hoke
6,800,119 B2 * 10/2004 Huang ..... B01D 46/10 422/123
7,080,505 B2 7/2006 Koermer
7,765,827 B2 * 8/2010 Schlom ..... F24F 5/0035 62/309
2008/0053309 A1 * 3/2008 Woodruff ..... B03C 3/09 96/18
2008/0256963 A1 * 10/2008 Mettier ..... F25B 39/04 62/336
2008/0283235 A1 * 11/2008 Verenkoff ..... F25B 39/04 165/281

(Continued)

FOREIGN PATENT DOCUMENTS

CN 2676077 Y * 2/2005

*Primary Examiner* — Frantz F Jules
*Assistant Examiner* — Martha Tadesse

(57) ABSTRACT

The air filtration and cooling system is configured for use with an incorporated reference. The incorporated reference is identified as U.S. Pat. No. 9,308,484. The incorporated reference processes an air flow. Specifically, the incorporated reference removes particulates from the air flow. The incorporated reference is discussed in greater detail elsewhere in this disclosure. The air filtration and cooling system comprises the incorporated reference and a cooling system. The cooling system cools the air flow processed by the incorporated reference.

6 Claims, 7 Drawing Sheets

(56) References Cited

U.S. PATENT DOCUMENTS

| | | | | |
|---|---|---|---|---|
| 2013/0047641 | A1* | 2/2013 | Townsend | F28B 11/00 62/305 |
| 2014/0075959 | A1* | 3/2014 | Lenkszus | F24F 6/043 62/305 |
| 2014/0174116 | A1* | 6/2014 | Habeebullah | F24F 5/0035 29/890.035 |
| 2015/0258488 | A1* | 9/2015 | Meirav | F24F 7/065 96/144 |
| 2016/0363333 | A1* | 12/2016 | Meirav | F24F 3/16 |
| 2017/0276382 | A1* | 9/2017 | Alazazmeh | F25B 39/00 |

* cited by examiner

AIR FILTRATION AND COOLING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of lighting and heating including ventilation, more specifically, self-contained air-cooling and filtration device.

This application incorporates by reference U.S. Pat. No. 9,308,484 that was issued on Apr. 12, 2016 to Mr. Clark Harper of Draper Utah. The associated USPTO application number is Ser. No. 14/294,740. The title of this patent is Environmental Air Filter.

The disclosure will specifically reference the following components from the incorporated reference 101: a first vent 121, a first fan 122, a first filter 123, a second vent 124, a second fan 125, a second filter 126, and a housing 111. The housing 111 is further defined with a chamber 112. The chamber 112 is a confined space that is enclosed by the housing 111. An air flow 127 is processed through the chamber 112 of the housing 111 by the first vent 121, the first fan 122, the first filter 123, the second vent 124, the second fan 125, and the second filter 126.

The applicant will emphasize that the USPTO properly found one or more patentable innovations that merited the granting of U.S. Pat. No. 9,308,484. The applicant notes that this disclosure will only reference the elements of the granted patent that are relevant to innovations disclosed within this application. This is done for purposes of simplicity and clarity of exposition. The fact that any specific innovation selected from the one or more innovations disclosed within U.S. Pat. No. 9,308,484 is not addressed in this application should not be interpreted as an indication of a defect in the above-referenced patent.

The following four paragraph describes the operating elements of the incorporated reference 101 that are relevant to this disclosure.

The housing 111 encloses the first fan 122, the first filter 123, the second fan 125, and the second filter 126 within the chamber 112. The first vent 121 forms an aperture through which atmospheric gases can flow. The second vent 124 forms an aperture through which atmospheric gases can flow. The first fan 122 draws atmospheric gases into the chamber 112 through the first vent 121 and the through the first filter 123 into the chamber 112. The second fan 125 pumps atmospheric gases from the chamber 112 and forces these atmospheric gases through the second filter 126 before discharging the atmospheric gases through the second vent 124. The flow of atmospheric gases through the chamber 112 is called the air flow 127.

The first fan 122 is an electrically powered device used for moving a gas. The second fan 125 is an electrically powered device used for moving a gas. The first filter 123 is a device that is used to remove particulates from the air flow 127. While the incorporated reference 101 is silent on this subject, this disclosure will assume that the first filter 123 is selected from the group consisting of a surface filter and an electrostatic filter. The second filter 126 is a device that is used to remove particulates from the air flow 127. While the incorporated reference 101 is silent on this subject, this disclosure will assume that the second filter 126 is selected from the group consisting of a surface filter and an electrostatic filter.

The applicant will observe that the relevant operational characteristics of the incorporated reference 101 can be summarized as follows. The first vent 121, the first fan 122, and the first filter 123 draws and filters atmospheric gas into the chamber 112. The second vent 124 and the second fan 125 discharges an air flow 127 that has been polished by the second filter 126.

The incorporated reference 101 discloses that the incorporated reference 101 is configured for use with a structure selected from the group consisting of a building and a vehicle.

SUMMARY OF INVENTION

The air filtration and cooling system is configured for use with an incorporated reference. The incorporated reference is identified as U.S. Pat. No. 9,308,484. The incorporated reference processes an air flow. Specifically, the incorporated reference removes particulates from the air flow. The incorporated reference is discussed in greater detail elsewhere in this disclosure. The air filtration and cooling system comprises the incorporated reference and a cooling system. The cooling system cools the air flow processed by the incorporated reference.

These together with additional objects, features and advantages of the air filtration and cooling system will be readily apparent to those of ordinary skill in the art upon reading the following detailed description of the presently preferred, but nonetheless illustrative, embodiments when taken in conjunction with the accompanying drawings.

In this respect, before explaining the current embodiments of the air filtration and cooling system in detail, it is to be understood that the air filtration and cooling system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the air filtration and cooling system.

It is therefore important that the claims be regarded as including such equivalent construction insofar as they do not depart from the spirit and scope of the air filtration and cooling system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
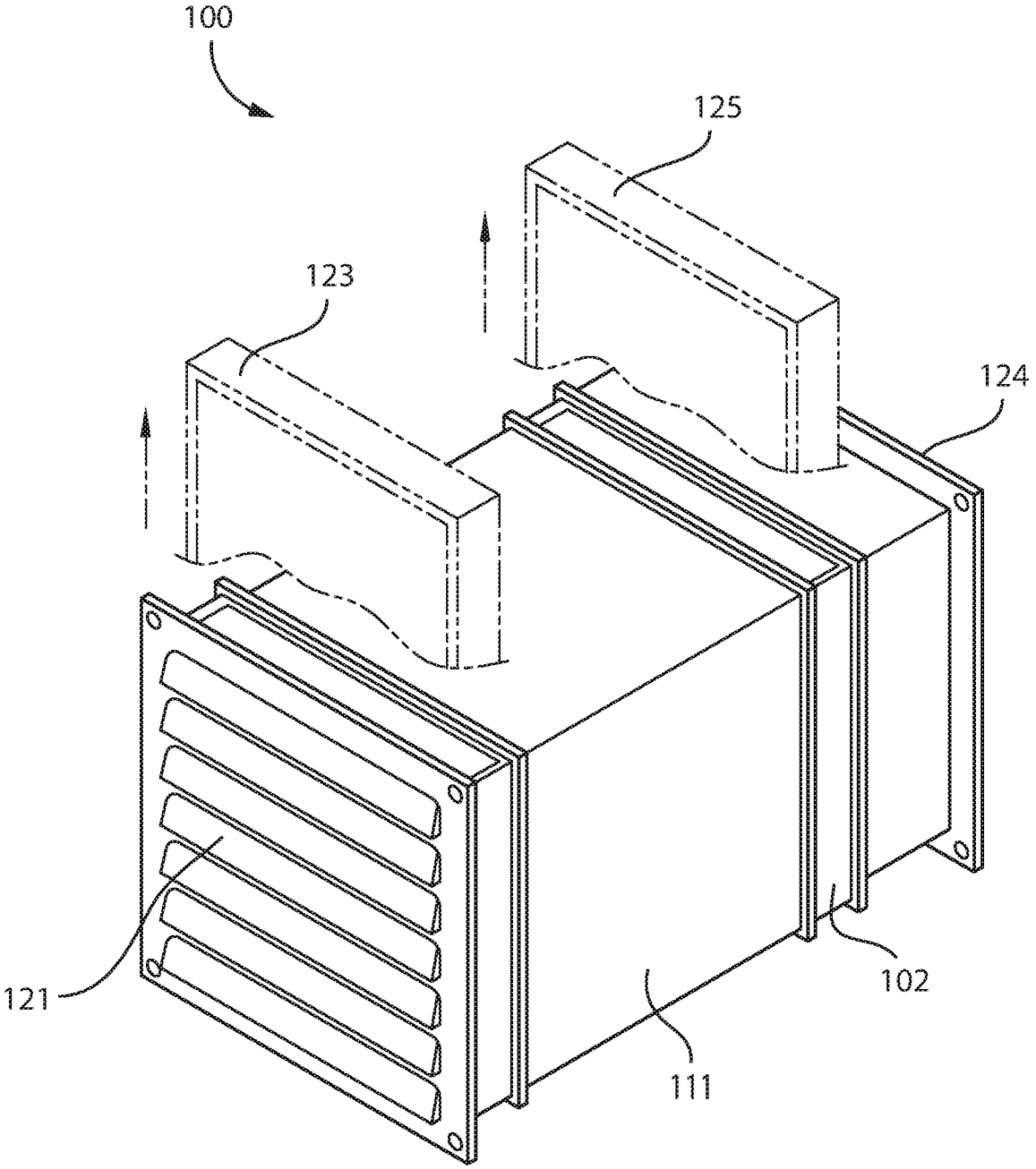
FIG. 1 is a perspective view of an embodiment of the disclosure.
Figure 2:
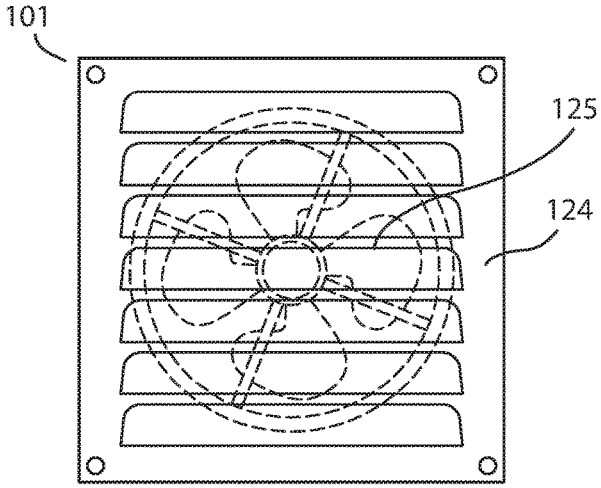
FIG. 2 is a front view of an embodiment of the disclosure.
Figure 3:
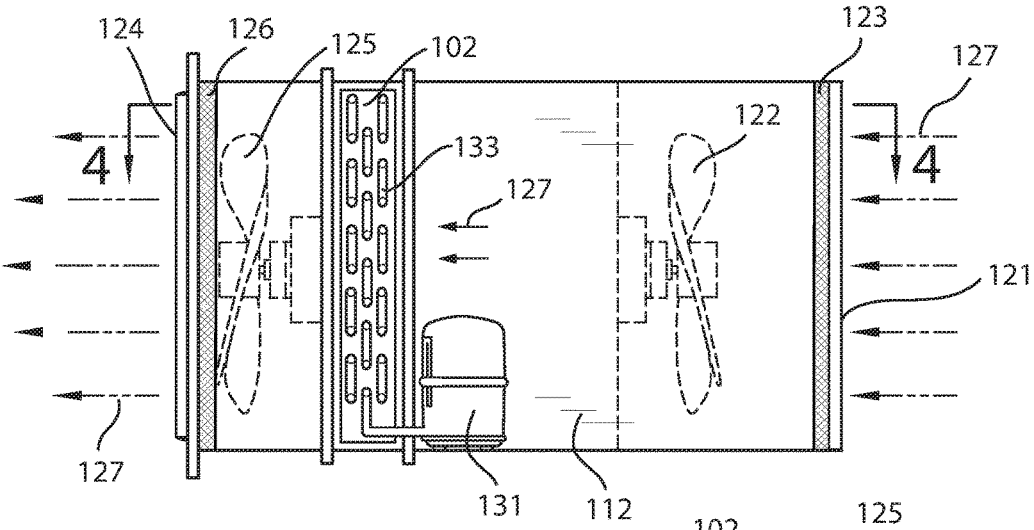
FIG. 3 is a side view of an embodiment of the disclosure.
Figure 4:
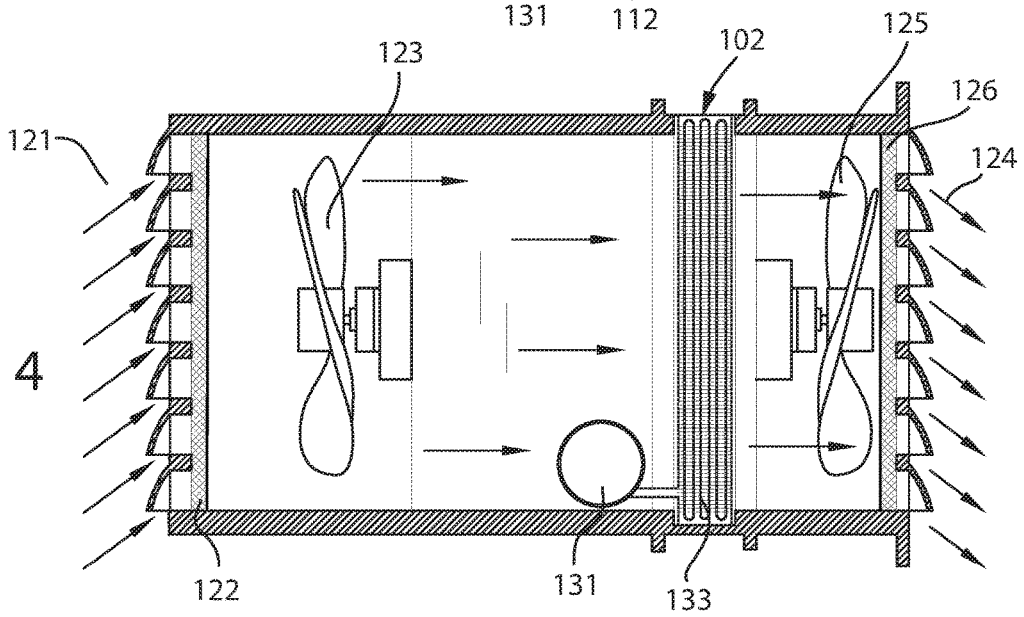
FIG. 4 is a top cross-sectional view of an embodiment of the disclosure across 4-4 as shown in FIG. 3.
Figure 5:
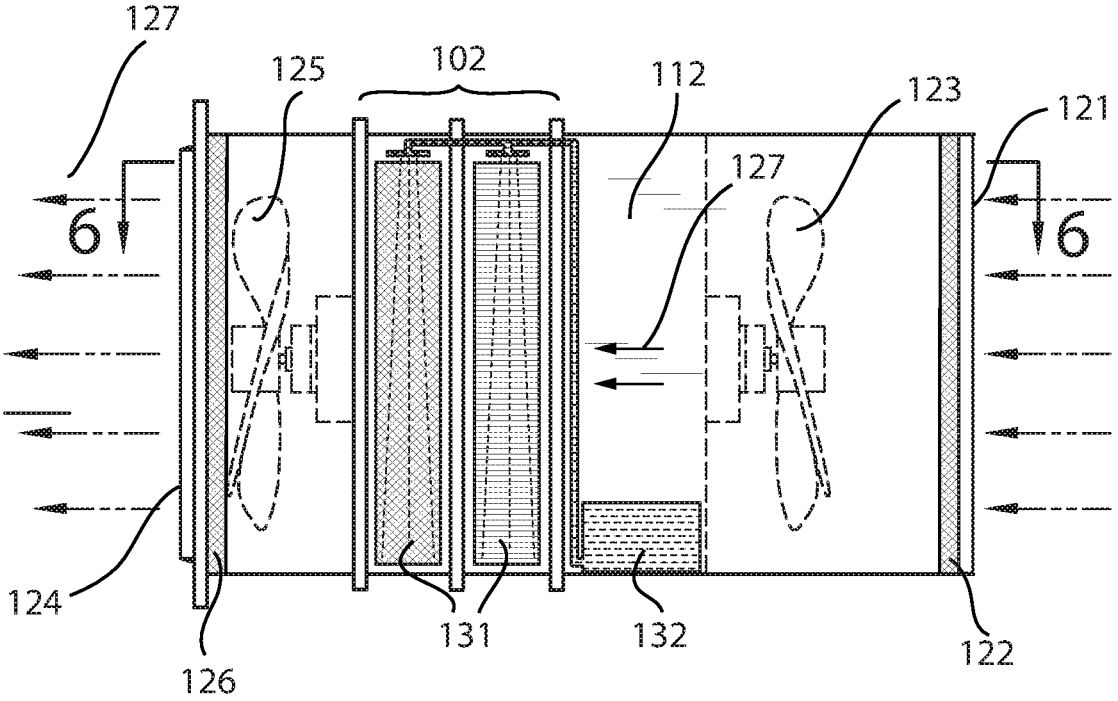
FIG. 5 is a side view of an alternate embodiment of the disclosure.
Figure 6:
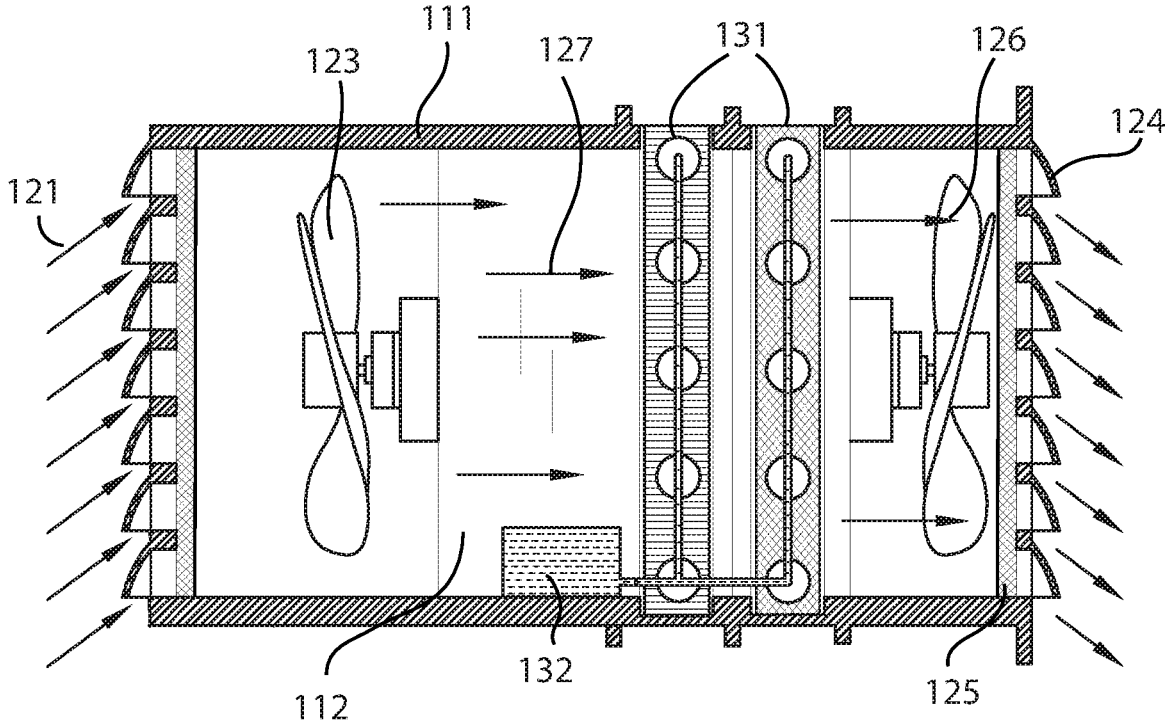
FIG. 6 is a top cross-sectional view of an embodiment of the disclosure across 6-6 as shown in FIG. 5.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 10.

The air filtration and cooling system 100 (hereinafter invention) is configured for use with an incorporated reference 101. The incorporated reference 101 is identified as U.S. Pat. No. 9,308,484. The incorporated reference 101 is configured for use with an air flow 127. The air flow 127 is drawn from atmospheric gases. The incorporated reference 101 processes the air flow 127. Specifically, the incorporated reference 101 removes particulates from the air flow 127. The incorporated reference 101 is discussed in greater detail elsewhere in this disclosure. The invention 100 comprises the incorporated reference 101 and a cooling system 102. The cooling system 102 cools the air flow 127 processed by the incorporated reference 101.

The incorporated reference 101 is an air filtration system that processes an air flow 127. The incorporated reference 101 comprises a housing 111, a first vent 121, a first fan 122, a first filter 123, a second vent 124, a second fan 125, and a second filter 126.

The housing 111 is a hollow casing. The housing 111 contains the first vent 121, the first fan 122, the first filter 123, the second vent 124, the second fan 125, the second filter 126, and the cooling system 102. The housing 111 is formed with all apertures and form factors necessary to allow the housing 111 to accommodate the use and operation of the invention 100. The chamber 112 is a hollow space formed within the housing 111. The air flow 127 passes through the chamber 112.

The first vent 121 is discussed in greater detail elsewhere in this disclosure. The first fan 122 is discussed in greater detail elsewhere in this disclosure. The first filter 123 is discussed in greater detail elsewhere in this disclosure. The second vent 124 is discussed in greater detail elsewhere in this disclosure. The second fan 125 is discussed in greater detail elsewhere in this disclosure. The second filter 126 is discussed in greater detail elsewhere in this disclosure.

In the first potential embodiment of this disclosure, the air flow 127 flows through the following components in the following order: 1) the first vent 121; 2) the first filter 123; 3) the first fan 122; 4) the cooling system 102; 5) the second fan 125; 6) the second filter 126; and, 6) the second vent 124.

The incorporated reference 101 is described in greater detail elsewhere in this disclosure.

The cooling system 102 is a heat exchange system. The cooling system 102 installs within the incorporated reference 101 such that the air flow 127 will pass through the cooling system 102. The cooling system 102 cools the air flow 127 as the air flow 127 passes through the cooling system 102.

In the first potential embodiment of this disclosure, the cooling system 102 forms a series of fluidic connections that form a fluidic circuit. The cooling system 102 comprises a pump 131, an expansion valve 132, a coil 133, a coil chamber 134, a return path 135, and a thermostat 136. The cooling system 102 is configured for use with a working fluid 137. The working fluid 137 is a commercially available refrigerant commonly used in heat exchange systems.

The pump 131 is a mechanical device that generates a pressure differential used for transporting the working fluid 137 through the cooling system 102.

The expansion valve 132 is a well-known and documented valve. The expansion valve 132 releases the working fluid 137 from the pump 131 into the coil 133. The expansion valve 132 releases the working fluid 137 with a corresponding drop in pressure.

The coil 133 is a heat exchange device. The coil 133 is a metal tube. The coil 133 is a radiator structure formed from a plurality of hairpin tubes. The working fluid 137 discharges from the expansion valve 132 directly into the coil 133. The coil 133 is positioned such that the air flow 127 passes through the hairpin tubes of the coil 133 for cooling.

The coil chamber 134 is an openwork structure that is installed in the chamber 112. The coil 133 mounts within the coil chamber 134 such that the air flow 127 passes through the coil chamber 134 to pass over the coil 133. The return path 135 is a fluidic connection between the discharge of the coil 133 and the fluid intake of the pump 131. The return path 135 completes the fluidic circuit of the cooling system 102. The thermostat 136 is a commercially available feedback device. The thermostat 136 controls the operation of the pump 131. Specifically, the thermostat 136 turns the pump 131 on and off based on a temperature that is measured by the thermostat 136.

The applicant anticipates that instantiations of the present disclosure will directly substitute for an instantiation of the incorporated reference 101. Specifically, an instantiation of the present disclosure can be installed in a building 161 such that the building 161 receives the benefits of both the incorporated reference 101 and the cooling benefits of the present disclosure. Similarly, an instantiation of the present disclosure can be installed in the cabin flow system of a vehicle (not shown) such that the cabin of the vehicle receives the benefits of both the incorporated reference 101 and the cooling benefits of the present disclosure.

The building 161 refers to a residential or commercial building 161 that would benefit from operating an instantiation of the incorporated reference 101. The vehicle refers to a motorized vehicle that would benefit from operating an instantiation of the incorporated reference 101.

Figure 7:
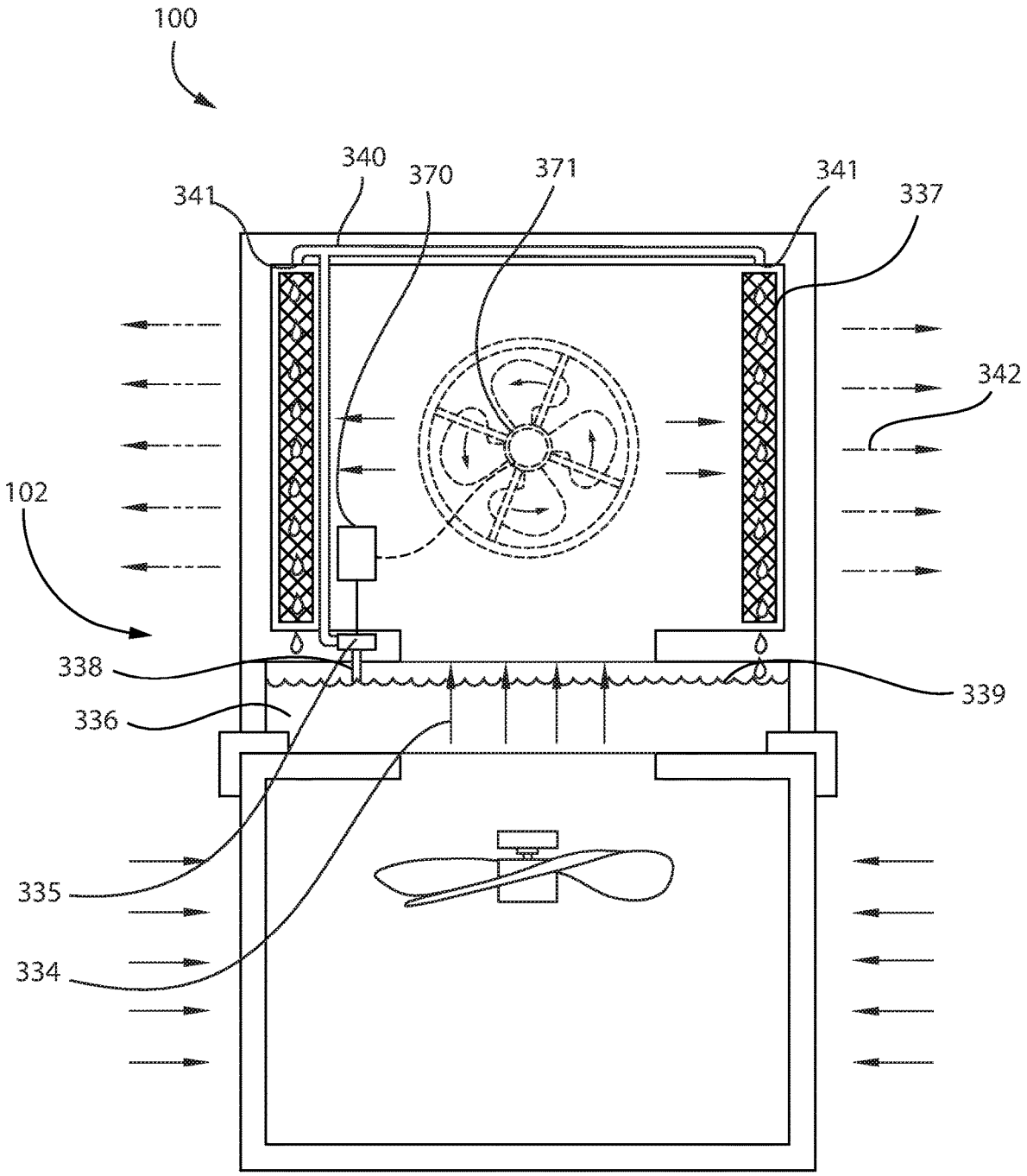
FIG. 7 is a side view of a water-cooled embodiment of the disclosure.
Figure 8:
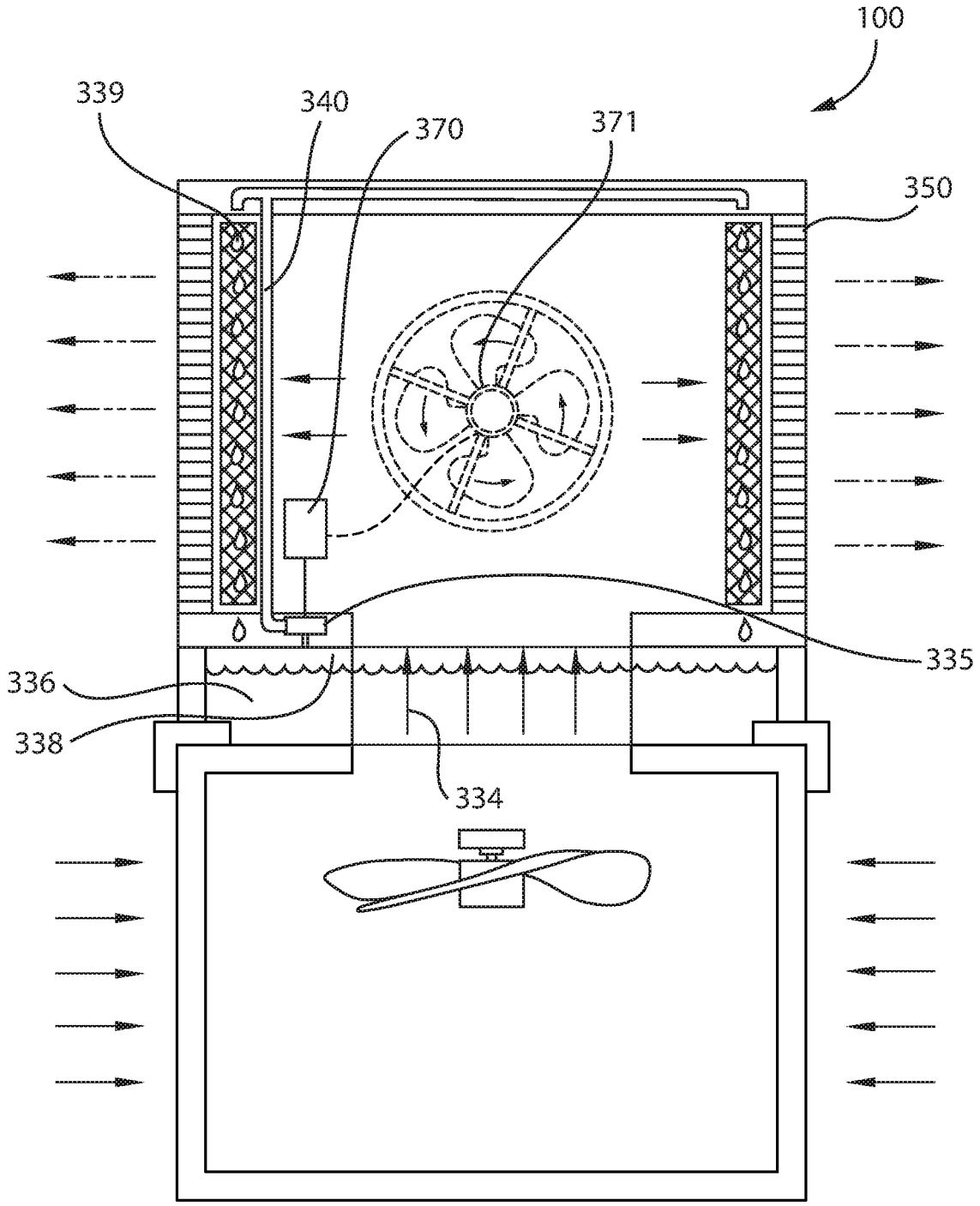
FIG. 8 is a side view of another water-cooled embodiment of the disclosure that includes an internal set of air filters.

Referring to FIGS. 7 and 8, an alternative embodiment of the invention 100 is depicted. More specific to FIG. 7, the invention 100 is adapted to be positioned atop of a condenser 333. It shall be noted that the condenser 333 may be the stand-alone portion of a residential AC unit or the window-mounted AC unit, which are well known. In either case, the invention 100 interfaces with the condenser 333 in order to cool the heated air 334 that is generated via the AC process. The heated air 334 exiting upward from the condenser 333 is directed into the housing 111 in order to cool the heated air 334. The difference between the embodiments of FIGS. 7-9 versus the embodiments of FIG. 106, is that the cooling system 102 of FIGS. 1-6 involves a refrigeration cycle; whereas the cooling system of FIGS. 7-9 uses a water-cooled system.

Figure 9:
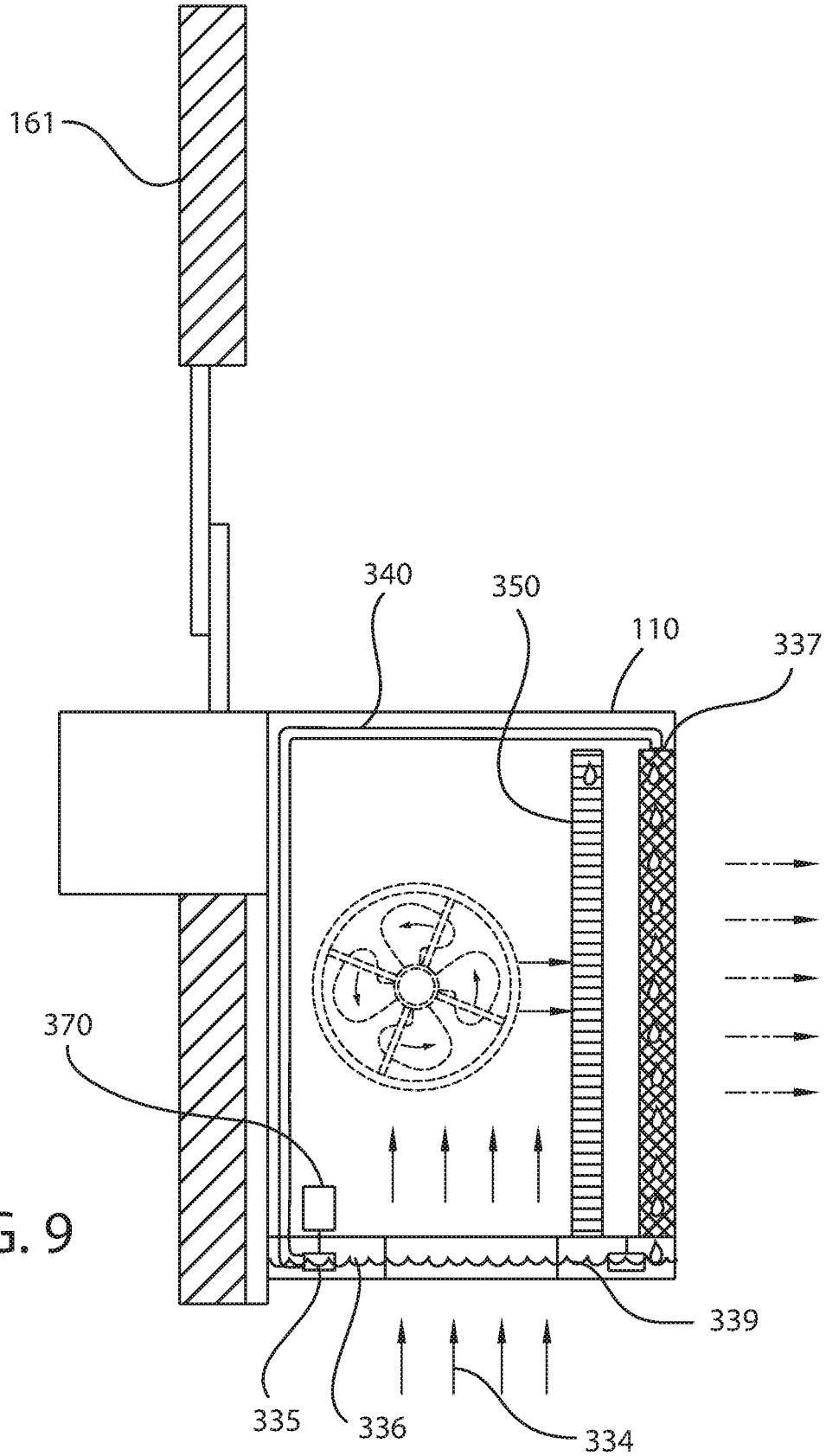
FIG. 9 is a side view of an alternative embodiment of the disclosure that is able to cool and filter contaminated ambient air.
Figure 10:
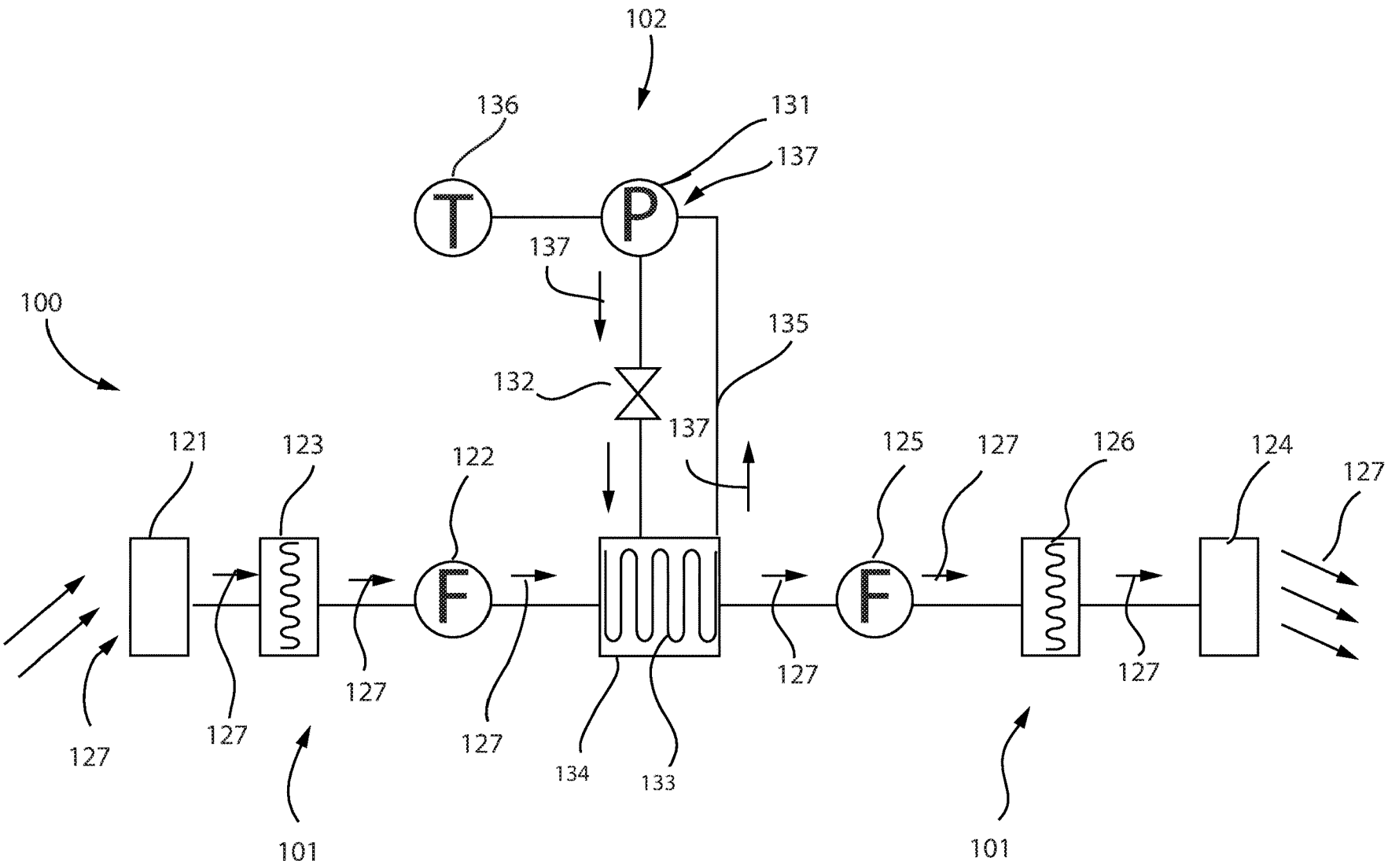
FIG. 10 is a schematic view of an embodiment of the disclosure.

The cooling system 102 of FIGS. 7-9 includes the use of a pump 335, which is in fluid connection with a reservoir 336. The pump 335 is able to move water held in the reservoir 336 to at least one evaporative pad 337. The pump 335 is further defined with a pump inlet 338 that transfers a fluid 339 (preferably water) from the reservoir 336 up a pump conduit 340. The fluid 339 is dispensed via the pump conduit 340 at least one conduit outlet 341 onto the at least one evaporative pad 337. As the fluid 339 traverses down the at least one evaporative pad 337, the heated air 334 is chilled into a cooled air 342. The cooled air 342 exits the housing 111 in order to mix with the ambient air of the outside environment. The pump 335 is wired to a control module 370, which is a logic module that controls power to the pump 335. The control module 370 is also wired to a cooling fan 371, which is able to draw in the heated air 335 into the housing 110. Moreover, the cooling fan 371 aids in propelling the heated air 335 across the at least one evaporative pad 341 in order to convert said heated air 335 into the chilled air 342.

FIG. 8 involves the same componentry as the embodiment depicted in FIG. 7 with the exception of an added air filter 350. The air filter 350 is provided in order to filter cooled air 342 prior to exiting the housing 111. It shall be noted that the air filter 350 may be positioned before or after the at least one evaporative pad 337 in order to filter the heated air 334 or the cooled air 342, respectively.

The following definitions were used in this disclosure:

Atmosphere: As used in this disclosure, the atmosphere refers to a blanket of gases (primarily nitrogen and oxygen) that surround the earth. Typical atmospheric conditions are approximated and characterized by the normal temperature and pressure.

Chamber: As used in this disclosure, a chamber is an enclosed or enclosable space that is dedicated to a purpose.

Electric Motor: In this disclosure, an electric motor is a machine that converts electric energy into rotational mechanical energy.

Electrostatic Filter: As used in this disclosure, an electrostatic filter is a device that removes particulates from an air flow. Specifically, the electrostatic filter generates an electric field that ionizes the particulates in the air flow and removes the ionized particulates by passing the air flow between electrically charged plates. The electrically charged plates physically attract the ionized particulates to the surface of the electrically charged plate thereby removing the particulates from the air flow.

Expansion Valve: As used in this disclosure, an expansion valve is a device that controls the release of a pressurized refrigerant into a heat exchange cycle. In most cases, the expansion valve will reduce that pressure of the refrigerant as the refrigerant discharges into the heat exchange cycle.

Fan: As used in this disclosure, a fan is a pump that moves a gas.

Filter: As used in this disclosure, a filter is a mechanical device that separates solids suspended in a liquid or a gas.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use fluidic connection are well-known and documented in the mechanical, chemical, and plumbing arts.

Gas: As used in this disclosure, a gas refers to a state (phase) of matter that is fluid and that fills the volume of the structure that contains it. Stated differently, the volume of a gas always equals the volume of its container.

Hairpin Tube: As used in this disclosure, a hairpin tube is a tube or pipe structure wherein tube or pipe is bent in a "U" shape reminiscent of a hairpin turn. This "U" reverses the actual physical direction of fluid flow while maintaining the direction of the fluid flow through the tube. Hairpin tube structures are often used in heat exchangers.

Housing: As used in this disclosure, a housing is a rigid casing that encloses and protects one or more devices.

Instantiation: As used in this disclosure, an instantiation refers to a specific physical object that is created using a specification.

Motor: As used in this disclosure, a motor refers to the method of transferring energy from an external power source into rotational mechanical energy.

Openwork: As used in this disclosure, the term open work is used to describe a structure, often a surface, which is formed with openings that allow for visibility and air flow through the structure. Wrought work and meshes are forms of openwork.

Pump: As used in this disclosure, a pump is a mechanical device that uses suction or pressure to raise or move fluids, compress fluids, or force a fluid into an inflatable object. Within this disclosure, a compressor refers to a pump dedicated to compressing a fluid or placing a fluid under pressure.

Refrigerant: As used in this disclosure, a refrigerant is a fluid used as the heat exchange medium in a heat exchange system.

Surface Filter: As used in this disclosure, a surface filter is a type of filter wherein the fluid is passed through a surface or membrane, such as a screen or paper that allows for the passage of the fluid but blocks the passage of larger particles that are suspended in the fluid. The construction of a surface filter would allow for the passage of the fluid through several filter surfaces in one filtration unit.

Thermostat: As used in this disclosure, a thermostat is a device that monitors the temperature of a space and that 1) operates a switch when the measured temperature exceeds or falls below a first preset temperature; and, 2) performs the opposite operation on the switch when the measured temperature falls below or exceeds a second preset temperature.

Vent: As used in this disclosure, a vent is an opening in a structure that allows for the flow of gas through the boundary of the structure.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A gas processing device comprising:

an air filtration system and a cooling system;

wherein the air filtration system is configured for use with an air flow;

wherein the air flow is drawn from atmospheric gases;

wherein the air filtration system processes the air flow;

wherein the air filtration system removes particulates from the air flow;

wherein the cooling system cools the air flow processed by the air filtration system;

wherein the air filtration system comprises a housing;

wherein the housing is adapted to interface with a condenser of an air-conditioning unit;

wherein a heated air of the condenser rises upwardly and is configured to enter said housing and be cooled via the cooling system;

wherein the cooling system includes a pump, which is in fluid connection with a reservoir;

wherein the pump moves a fluid held in the reservoir to at least one evaporative pad;

wherein said at least one evaporative pad interfaces with said heated air in order to chill said heated air into a cooled air;

wherein the pump is wired to a control module, which controls the pump;

wherein the control module is wired to a cooling fan, which is able to draw in the heated air into the housing;

wherein the cooling fan propels the heated air across the at least one evaporative pad in order to convert said heated air into the chilled air;

wherein an air filter is located inside of said housing;

wherein said air filter is adjacent to said at least one evaporative pad;

wherein the air filter is provided in order to filter the cooled air prior to exiting the housing and into the atmosphere.

2. The gas processing device according to claim 1 wherein the housing is a hollow casing;

wherein the housing is further defined with a chamber;

wherein the chamber is a hollow space formed within the housing;

wherein the air flow passes through the chamber.

3. The gas processing device according to claim 2 wherein the cooling system is a heat exchange system;

wherein the cooling system installs within the air filtration system such that the air flow will pass through the cooling system;

wherein the cooling system cools the air flow as the air flow passes through the cooling system.

4. The gas processing device according to claim 3 wherein the cooling system forms a series of fluidic connections that form a fluidic circuit.

5. The gas processing device according to claim 4 wherein the housing is adapted to be positioned atop of said condenser.

6. The gas processing device according to claim 5 wherein the pump is further defined with a pump inlet that transfers said fluid from the reservoir up a pump conduit; wherein the fluid is dispensed via the pump conduit at least one conduit outlet onto the at least one evaporative pad; wherein as the fluid traverses down the at least one evaporative pad, the heated air is chilled into said cooled air; wherein the cooled air exits the housing.

* * * * *